US005791390A

United States Patent [19]

Watanabe

[11] Patent Number: 5,791,390

[45] Date of Patent: Aug. 11, 1998

[54] SINGLE CONTROL SYSTEM FOR OPERATING TOP-DOWN-BOTTOM-UP SHADES

[75] Inventor: Kelly A. Watanabe, Rye Brook, N.Y.

[73] Assignee: RollEase, Inc., Stamford, Conn.

[21] Appl. No.: 796,229

[22] Filed: Feb. 6, 1997

[51] Int. Cl.[6] ..... A47H 5/00

[52] U.S. Cl. ..... 160/84.03; 160/115; 160/167; 160/168.1 R

[58] Field of Search ..... 160/84.03, 167 R, 160/170 R, 115, 168.1 R, 176.1 R, 84.04

[56] References Cited

U.S. PATENT DOCUMENTS

| | | | |
|---|---|---|---|
| 169,502 | 11/1875 | Wideman | 160/167 R X |
| 340,960 | 4/1886 | Stevens | 160/115 X |
| 2,110,983 | 3/1938 | Carver | 160/167 R X |
| 2,765,030 | 10/1956 | Bechtler | 160/170 R |
| 4,799,524 | 1/1989 | Gruermonprez | 160/84.03 |
| 4,813,468 | 3/1989 | Fraser | 160/84.03 |
| 5,351,737 | 10/1994 | Hoshiyama | 160/84.03 |

*Primary Examiner*—Blair Johnson

*Attorney, Agent, or Firm*—Gottlieb, Rackman & Reisman, P.C.

[57] ABSTRACT

A lift system for top-down, bottom-up window shades operated by a single control is provided. The preferred embodiment of the invention is compatible with, but not limited to, clutch operated shades whose cords are wound onto a shaft within the headrail. It will work with any shade that presently has top-down-bottom-up capability, using any method of lift.

21 Claims, 4 Drawing Sheets

SINGLE CONTROL SYSTEM FOR OPERATING TOP-DOWN-BOTTOM-UP SHADES

BACKGROUND TO THE INVENTION

This invention relates to pleated and other window shades, generally made of cloth, that are opened by causing the fabric to stack rather than roll. More particularly, our invention relates to top-down-bottom-up shades.

Most fabric window shades that do not roll have a headrail mounted at or above the top of the window from which the fabric depends, and a bottom rail attached along the lower edge of the fabric. Conventional pleated shades are opened and closed by raising and lowering the bottom rail so that, in the open position, the fabric stacks against the headrail at the top of the window.

Top-down-bottom-up shades are made so that they can be raised and lowered from the top as well as from the bottom, allowing the user, selectively, to cover either the upper part, the lower part, or the entire window. Prior art top-down-bottom-up (TDBU) shades can be lowered and raised from the top or from the bottom. However, these prior art TDBU shades are awkward to use because they require two independent lift systems, one to operate and hold the bottom rail and one to operate and hold the middle rail. Although these mechanisms operate independently of one another, their operation must be properly coordinated or the lift cords can become slack, tangle, and ultimately jam the system. Our invention uses a single lift system which makes TDBU shades easy to operate and eliminates the possibility of slack lift cords by permitting the shade to function only in the proper operating sequence.

In a variation of prior art TDBU shades, in addition to the fabric in the lower section, there is also fabric in the upper section, between the headrail and the middle rail. This version can be opened by raising both the middle and bottom rails fully, so that both fabric covered sections are stacked against the bottom of the headrail. Our invention provides a new and advantageous operating mechanism for both types of TDBU shades.

SUMMARY OF THE INVENTION

The present invention is a lift system for TDBU shades operated by a single control. The preferred embodiment of the invention is compatible with, but not limited to, clutch operated shades whose cords are wound onto a shaft within the headrail. It will work with any shade that presently has top-down-bottom-up capability, using any method of lift. Our invention, as do TDBU systems of the prior art, has a headrail, a moveable middle rail and a moveable bottom rail. Fabric is attached between the middle rail and the bottom rail and, optionally, between the headrail and the middle rail. Our invention differs from prior art systems in the way the lift cords are routed, and the hardware required to accomplish the unique routing. Preferably, rollers and grommets are used to reduce friction wherever the cord path is turned within the system. However, the invention does not require their use, and grommets of low friction material will also work. The cord paths as shown in the drawings are isolated to prevent friction of the cord against itself. However, this also is also optional.

Shades that use this type of fabric require that lift cords be spaced approximately 18 to 30 inches apart. This spacing is required to properly support the pleats in the fabric. Our inventive cord routing system is used for each lift cord.

Accordingly, it is an object of our invention to provide a single lift mechanism to operate both the upper and the lower sections of a top-down-bottom-up shade.

It is a further object of our invention to provide a lift system that prevents tangling of lift cords due to improper operation.

It is a further object of our invention to provide a lift system for TDBU shades that is easy to operate.

Other objects and advantages of our invention will become apparent from the descriptions that follow.

BRIEF DESCRIPTION OF THE DRAWINGS

Further understanding of our invention will become apparent upon consideration of the following detailed description in conjunction with the drawings, in which.

DETAILED DESCRIPTION OF THE DRAWINGS

Figure 1:
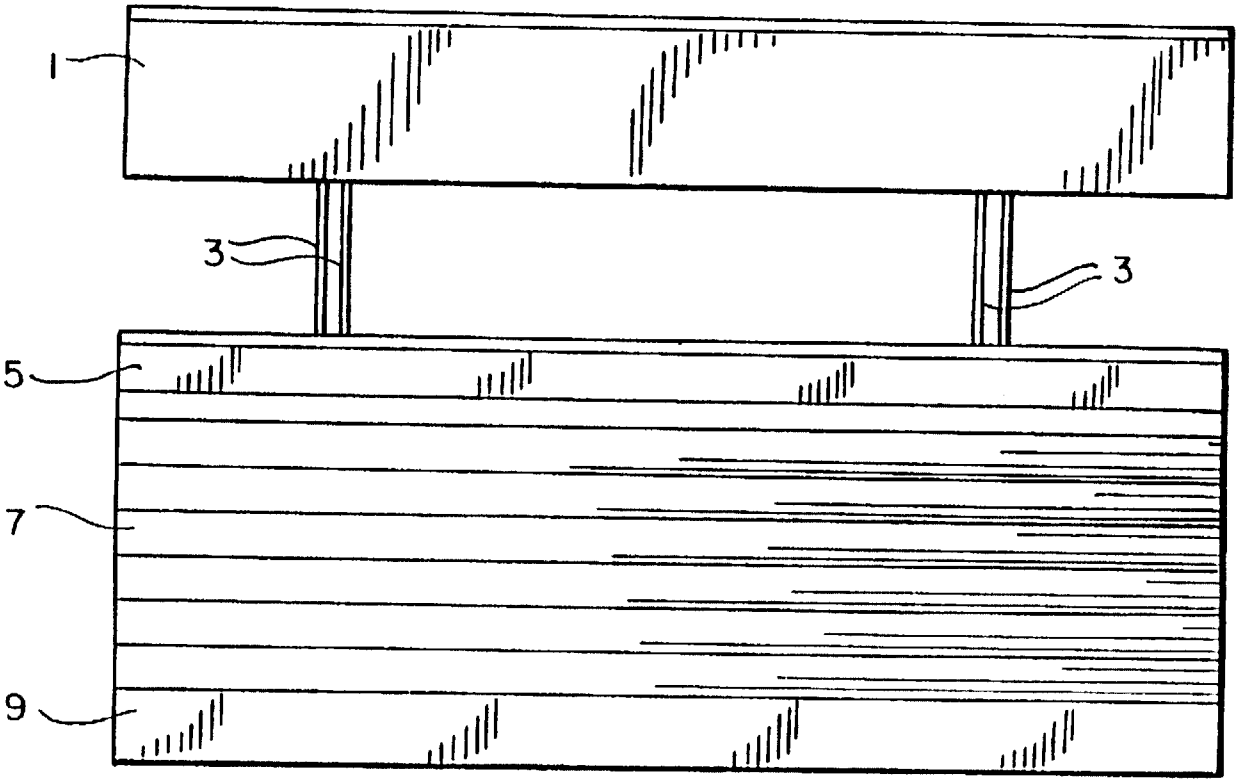
FIG. 1 is a frontal view of a top-down-bottom-up shade which has no shade material in the upper section.

Referring now to FIG. 1, headrail 1 contains the mechanism for raising and lowering the shade. In the preferred embodiment, lift cords are accumulated on a rotating shaft within headrail 1 according to the principles of U.S. Pat. No. 4,623,012, but it is also acceptable to route the cords through the headrail and capture them with a standard cord lock mechanism.

FIG. 1 shows middle rail 5 in an intermediate position, partially lowered. Shade material 7 is attached along its upper edge to middle rail 5, and along its lower edge to bottom rail 9.

Figures 2A, 2B, 2C, 2D, 2E:
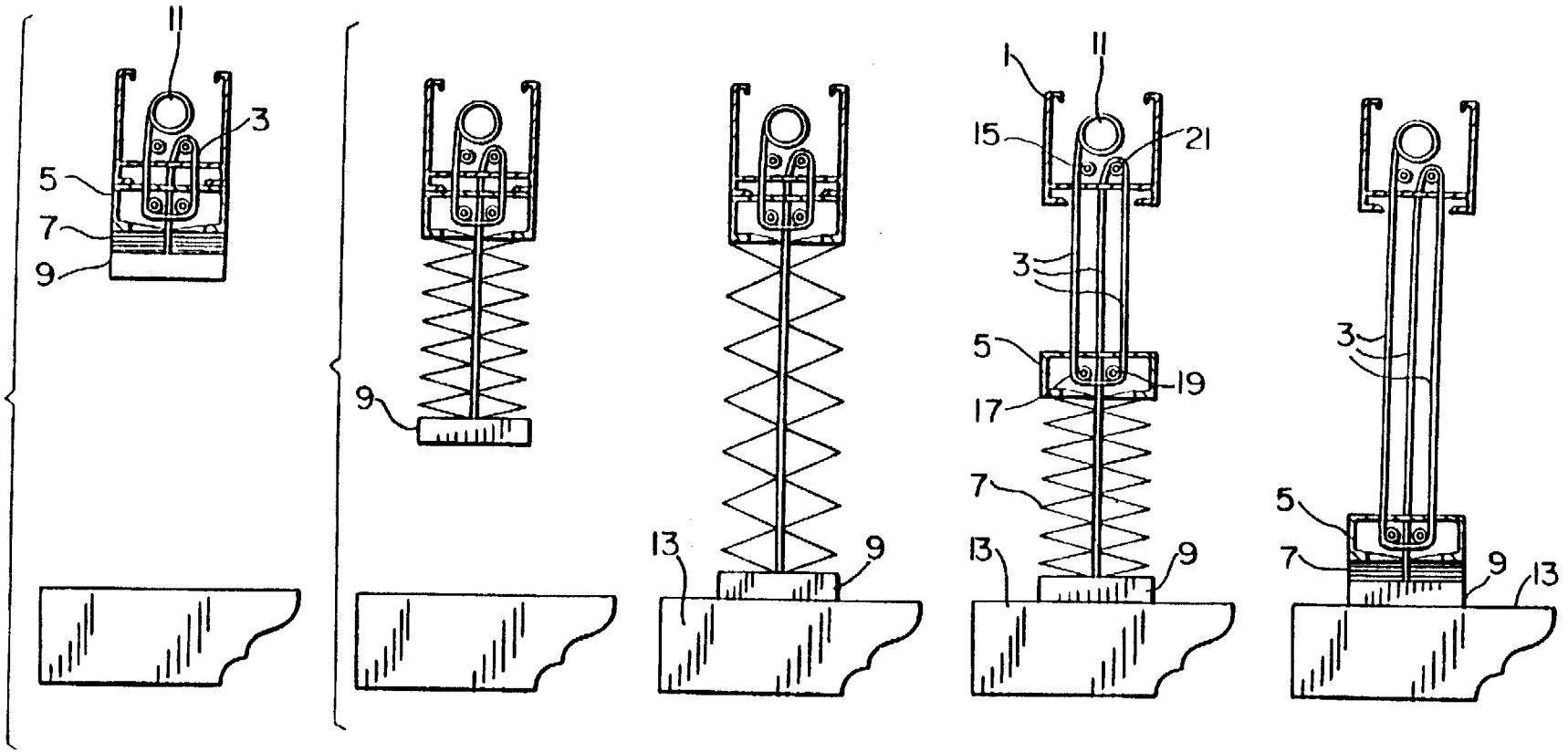
FIG. 2 is a cross-sectional view of the shade of FIG. 1 showing the shade in five different positions, (a) through (e)

FIG. 2 (a) depicts the shade fully raised, with cord 3 wound onto shaft 11.

FIG. 2 (b) shows the shade with bottom rail 9 partially lowered as some of cord 3 has been unwound from shaft 11.

In FIG. 2 (c), cord 3 has been further unwound, allowing bottom rail 9 to reach window sill 13.

Still more cord has been unwound in FIG. 2 (d), permitting middle rail 5 to drop to the center of the window. The cord routing that makes this possible is best seen in FIG. 2. (d). Four rollers, 15, 17, 19 and 21 are so mounted that their centers form a rectangle. Rollers 15 and 21 are mounted within the headrail, and rollers 17 and 19 within the middle rail. From shaft 11, on which the cord wraps, cord 3 passes over roller 15, through an exit hole in the bottom of headrail 1, thence through a hole in the top of middle rail 5, around rollers 17 and 19 and out through another hole in the top of middle rail 5. Cord 3 then passes again into headrail 1, around roller 21. From Roller 21 cord 3 exits headrail 1 through an opening on the bottom centerline, passes through holes in middle rail 5, and is attached to bottom rail 9.

Until bottom rail 9 contacts window sill 13, there are two parts or strands of cord 3 supporting middle rail 5, whereas only a single part or strand supports bottom rail 9. This provides a mechanical advantage of two, so that, in the absence of friction in the roller bearings and any effect from the shade material, for equally weighted middle and bottom rails, middle rail 5 will be held against headrail 1 until bottom rail 9 reaches window sill 13. In the preferred embodiment, bottom rail 9 has sufficient weight to produce this condition, that is, to hold middle rail 5 against headrail 1 until bottom rail 9 is resting on window sill 13. Shade material 7 is often of a pleated or cellular configuration which can be somewhat spring-like, requiring some force for its extension. Shade materials such as this may require some additional weight in bottom rail to accomplish this sequence of operation which is desirable, but not necessary for our invention. Friction in the roller bearings may also add slightly to the weight required in the bottom rail, but the fact that the bottom rail acts with mechanical advantage minimizes this requirement and experience has shown that it is not a problem.

Referring now to FIG. 2 (e), further unwinding of cord 3 has lowered middle rail 5 until shade material 7 is closely stacked on top of bottom rail 9 at the bottom of the window opening.

The shade is raised by rewinding cord 3 onto shaft 11. As the cord is rewound, middle rail 5 lifts first. When middle rail 5 is again in contact with headrail 1, bottom rail 9 lifts.

In this way, according to the principles of our invention, the shade can be positioned to produce any desired opening either in the bottom or the top portion of the window.

The preferred embodiment has the lift cords either on the centerline, or symmetrically disposed about the centerline, of the headrail, middle rail, and bottom rail. Other routing paths are possible without departing from the spirit and scope of our invention. For instance, it would be possible to position rollers or guides to route the cords along or near either the front or the back of the three rails to keep them out of sight when using z-folded pleated shade material.

Figures 3A, 3B, 3C, 3D, 3E:
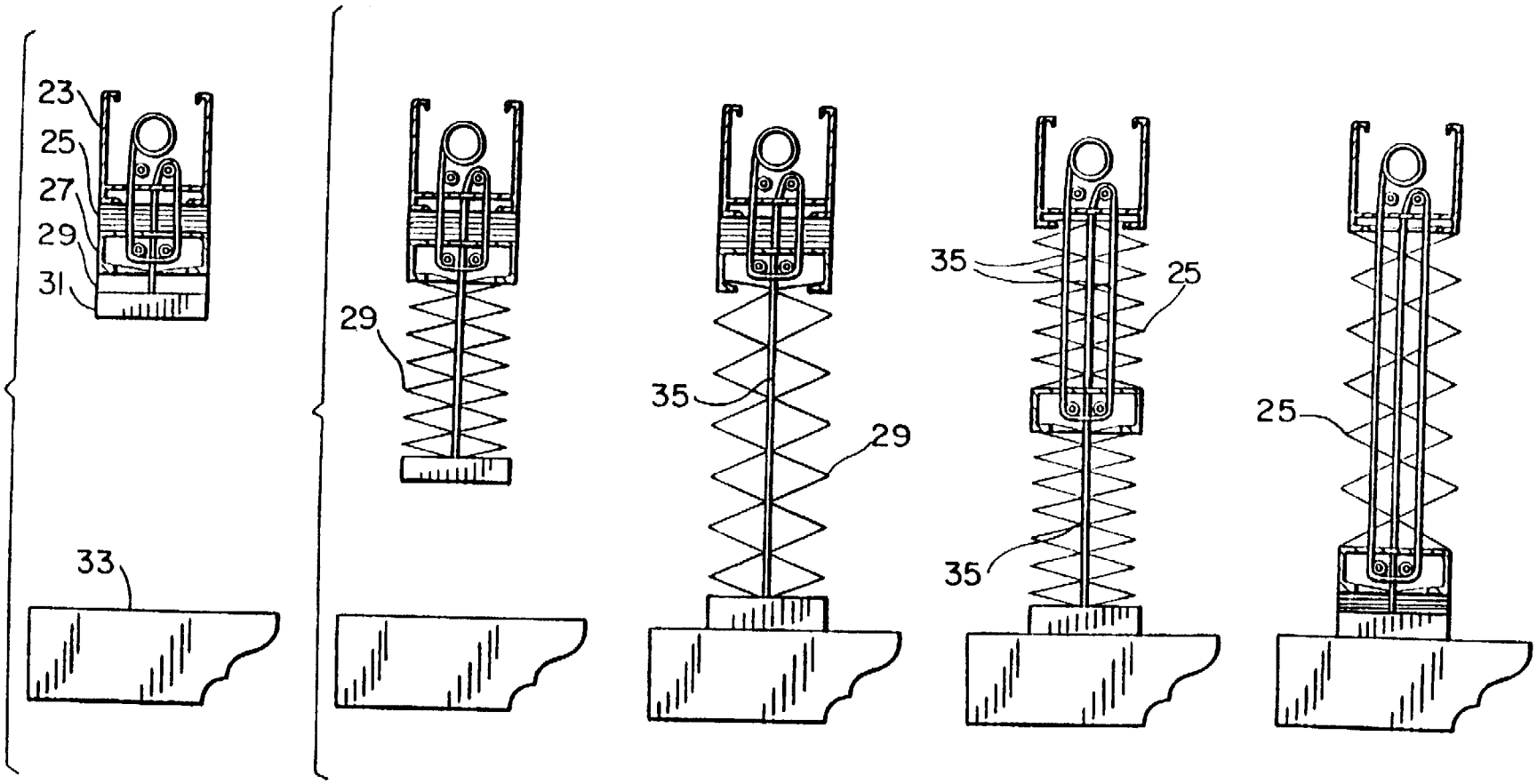
FIG. 3 is a view similar to that of FIG. 2, but of a shade having material in the upper section; and, FIG. 4 is a cross-sectional view of a TDBU shade with an alternative routing for the cords shown partially lowered so that the bottom rail is on the window sill, and the bottom half of the window is covered by the fabric in the lower section.

FIG. 3 depicts a shade that also operates according to the principles of our invention, which has fabric in the upper section as well as the lower section. Usually, the two sections would have fabrics of different characteristics. For instance, one might by nearly transparent, while the other could be opaque. This provides the user with two different coverings for the window and still allows the shade to be raised so that the window is clear.

Upper fabric 25 is attached to headrail 23 along its upper edge and, along its bottom edge to middle rail 27. Lower fabric 29 is attached between middle rail 27 and bottom rail 31 as in the embodiment of FIG. 2. The shade of FIG. 3 is shown fully raised in FIG. 3 (a), and the same stages of lowering the shade are shown in FIG. 3 (b) through (e) as are shown in the corresponding views of FIG. 2. Cord 35 passes through both the upper and lower fabric as best seen in FIG. 3 (c) and (d).

When the shade is fully lowered, as seen in FIG. 3 (e), upper fabric 25 is extended across the window.

Figure 4:
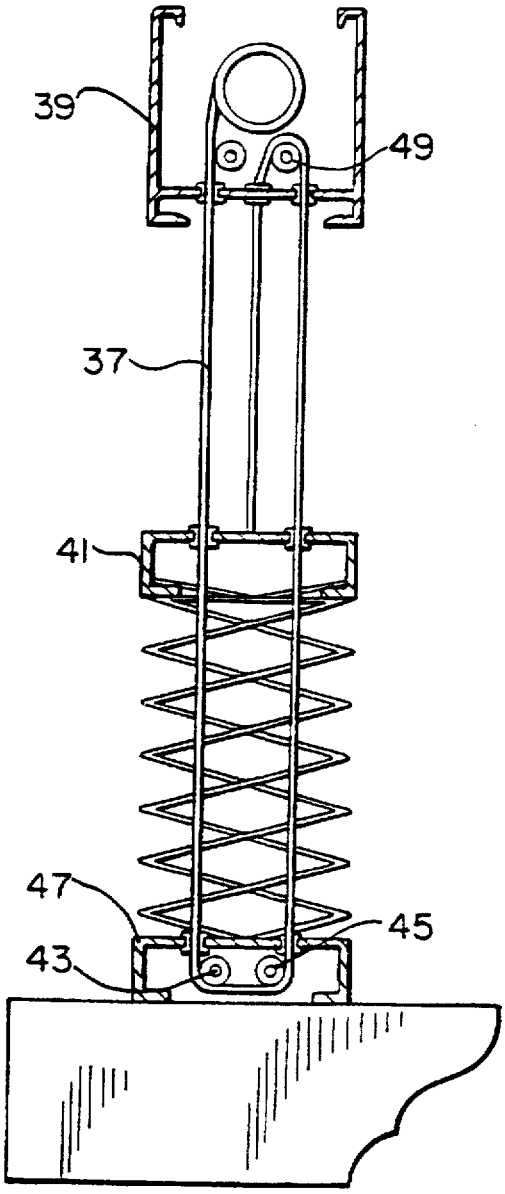

In the alternative routing shown in FIG. 4, cord 37, upon passing out of the bottom of headrail, passes through clearance holes in middle rail 41, and around rollers 43 and 45 which are mounted in bottom rail 47. From there, it is routed back through middle rail 41, into headrail 39 wherein the cord passes over roller 49, out of headrail 39, and to a termination on middle rail 41. This method of routing the cord requires additional weight in bottom rail 47 since the routing produces a mechanical advantage of two for the lifting force on bottom rail 47 relative to middle rail 41.

In another variation of our invention, the upper fabric can be replaced by a Venetian blind. For that configuration, the tilt mechanism would reside in the headrail, as it normally does.

Our invention provides for a two material shade, with a moveable middle rail and a moveable bottom rail, and is operated by a single control. Because the middle rail is moveable, the ratio of one material's coverage to the other material's coverage is infinitely variable. Because the bottom rail is moveable the shade can be completely raised, so that there is nothing blocking the window.

It will thus be seen that the objects set forth above among those made apparent from the preceding description, are efficiently attained and, since certain changes may be made in the construction of the inventive spring clutch without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A top-down-bottom-up window shade lifting and lowering system comprising:

a window shade;

a headrail;

at least one lift/lowering cord for said shade;

a middle rail from which one edge of said window shade is attached;

a lower rail from which a second opposite edge of said window shade is attached;

wherein said lift/lowering cord is routed through all of said rails such that a single control mechanism is provided for selectively lowering and raising said shade in order for said shade to selectively cover at least a portion of a window.

2. The system of claim 1, wherein said at least one cord passes out of said headrail through the middle rail, then back through the headrail, and finally to said bottom rail where it is attached.

3. The system of claim 1, wherein said headrail includes a rotating shaft on which said at least one cord is accumulated.

4. The system of claim 1, wherein said headrail includes at least one support on which said at least one cord is carried and said middle rail includes at least one support on which said at least one cord is carried.

5. The system of claim 4, wherein each of said at least one supports comprises at least one roller.

6. The system of claim 2, wherein said middle rail includes an entrance hole through which said at least one cord travels through and an exit hole through which said at least one cord travels through.

7. The system of claim 1, wherein said bottom rail is weighted.

8. The system of claim 1, wherein said at least one cord is routed through said rails such that said middle rail has at least a two part support and said bottom rail has only a single part support.

9. The system of claim 1, wherein said window has a sill and said middle rail is held substantially against said headrail during lowering of said shade until said bottom rail is lowered by said control mechanism to said window sill.

10. The system of claim 9, wherein said bottom rail is maintained substantially on said window sill during raising of said shade by said control mechanism until said headrail is lifted to be in contact with said headrail.

11. The system of claim 1, further including a second shade having one edge attached to said headrail and a second opposite edge attached to said middle rail.

12. The system of claim 1, wherein said middle rail has a weight which is less than twice the weight of said bottom rail.

13. The system of claim 1, wherein said at least one cord passes out of said headrail through the bottom rail, back through the headrail, and then finally to said middle rail where it is attached.

14. The system of claim 1, wherein said at least one cord is routed through said rails such that said bottom rail has at least a two part support and said middle rail has only a single part support.

15. A top-down-bottom-up window shade lifting and lowering system comprising:

at least one lifting/lowering cord; and upper, lower and middle rails through which said at least one cord is routed;

wherein said at least one cord passes out of said headrail through the middle rail, then back up through the headrail and finally to said bottom rail, where it is attached such that a single control is achieved for selectively lowering and raising a window shade.

16. The system of claim 15, wherein said headrail includes at least one support on which said at least one cord is carried and said middle rail includes at least one support on which said cord is carried.

17. The system of claim 15, wherein said at least one cord is routed through said rails such that said middle rail has at least a two part support and said bottom rail has only a single part support.

18. The system of claim 15, wherein said middle rail has a weight which is less than twice the weight of said bottom rail.

19. A top-down-bottom-up window shade lifting and lowering system comprising:

at least one lifting/lowering cord;

upper, lower and middle rails through which said at least one cord is routed;

wherein said middle rail has at least a two part support and said bottom rail has only a single part support.

20. The system of claim 19, wherein said at least one cord passes out of said headrail through the middle rail, then back through the headrail, and finally to said bottom rail where it is attached.

21. The system of claim 19, wherein said middle rail has a weight which is less than twice the weight of said bottom rail.

* * * * *